United States Patent [19]

Davies

[11] Patent Number: 4,538,772

[45] Date of Patent: Sep. 3, 1985

[54] WINDING APPARATUS

[76] Inventor: Richard E. Davies, 1 Homelands Ave., Angmering-on-Sea, West Sussex, England

[21] Appl. No.: 519,768

[22] PCT Filed: Nov. 2, 1982

[86] PCT No.: PCT/GB82/00313

§ 371 Date: Jul. 1, 1983

§ 102(e) Date: Jul. 1, 1983

[87] PCT Pub. No.: WO83/01610

PCT Pub. Date: May 11, 1983

[30] Foreign Application Priority Data

Nov. 4, 1981 [GB] United Kingdom ..... 8133237

[51] Int. Cl.[3] ..... B65H 54/02

[52] U.S. Cl. ..... 242/18 R; 242/18 DD; 242/45

[58] Field of Search ..... 242/18 R, 18 B, 18 DD, 242/45, 65, 66, 67.1 R

[56] References Cited

U.S. PATENT DOCUMENTS

| | | | |
|---|---|---|---|
| 2,972,450 | 2/1961 | Brierley | 242/18 R |
| 3,279,718 | 10/1966 | Arterton et al. | 242/67.1 R |
| 3,288,383 | 6/1964 | Muller | 242/45 |
| 3,366,340 | 1/1968 | Mackie | 242/18 R |
| 3,617,009 | 11/1971 | Lawson et al. | 242/18 R |
| 3,670,980 | 6/1972 | Mukai et al. | 242/67.1 R |
| 3,743,202 | 7/1973 | Hoffsommer et al. | 242/45 |
| 3,844,502 | 10/1974 | Toy, Jr. | 242/67.1 R |
| 3,977,619 | 8/1976 | Nagata et al. | 242/67.1 R |
| 4,009,839 | 3/1977 | Bense | 242/18 DD |
| 4,049,211 | 9/1977 | Spescha | 242/45 |
| 4,059,239 | 11/1977 | Hori et al. | 242/18 R X |
| 4,106,710 | 8/1978 | Schippers et al. | 242/18 R |
| 4,150,797 | 4/1979 | Kataoka | 242/67.1 R |
| 4,184,646 | 1/1980 | Seney | 242/18 DD X |

FOREIGN PATENT DOCUMENTS

| | | |
|---|---|---|
| 1258230 | 1/1968 | Fed. Rep. of Germany . |
| 2290379 | 6/1976 | France . |
| 2330632 | 6/1977 | France . |

*Primary Examiner*—Stanley N. Gilreath

*Attorney, Agent, or Firm*—Roylance, Abrams, Berdo & Goodman

[57] ABSTRACT

This invention relates to apparatus for winding flexible material on to a mandrel and provides a control system for automatically controlling the packing density of the wound material. The mandrel (M) is rotatably mounted on one end of an arm (A) which is mounted to pivot about a horizontal axis (F) at the other end of the arm. The package being wound rests on a bar (PB) and pressure is applied to the periphery of the package by a weight (W). The effect of the weight (W) is reduced by a piston slidable in a cylinder, air pressure (p) being applied to the underside of the piston. The air is provided by means of a pump driven by an electric motor through a mark-space control. This control varies the mean speed of the pump in dependence on an error signal derived from the difference between the output of a load sensor and a reference value. In addition, the reference signal may be varied by means of a measurement of the diameter of the package.

11 Claims, 6 Drawing Figures

WINDING APPARATUS

This invention relates to apparatus for winding flexible material on to a mandrel, and is particularly, but not exclusively, applicable to the winding of thread into a package.

Apparatus is known for winding flexible material on to a mandrel, said apparatus including a motor for rotating the mandrel and means for applying pressure to the periphery of the package being wound in order to control the packaging density. The pressure-applying means may consist, for example, of a bar or roller, and the flexible material passes between the bar and the package as it is being wound. Normally the bar or roller is fixed in the vertical direction, and the pressure results from the reaction force caused by pressing the package against the bar or roller. For this purpose, the mandrel may be rotatably mounted at one end of an arm which is pivotted at the other end about a horizontal axis. Adjustable weights may be connected to the arm in order to press the package against the bar or roller.

It is to be understood that variations in the value of the pressure applied to the package will cause variations in the packing density. As the amount of material in the package increases, the weight of the package will increase, and this will cause an increase in the applied pressure. If it is required to maintain a constant packing density, means will have to be provided to reduce the weight on the arm as the diameter, and hence the weight, of the package increases.

At the present time, adjustment of the weight is normally carried out manually by the operator. This adjustment requires skill, and is frequently unreliable because of effects which the operator is unable to take into account. For example, frictional forces are liable to vary during operation of the weight-compensation apparatus, and the operator will not normally be able to compensate for such variations. In addition, the package may be distorted during winding due to penetration of the pressure bar or roller, and again it is difficult for an operator to assess such penetration and make the necessary adjustment of the weight.

Accordingly, it is an object of the present invention to provide apparatus having a control system for automatically controlling the packing density by controlling the pressure applied to the periphery of the packing during winding.

From one aspect the invention consists in apparatus for winding flexible material on to a mandrel including a motor for rotating the mandrel; means for applying pressure to the periphery of the package of said material wound on the mandrel; means for measuring a value which varies with the pressure applied to the package; means for comparing the measured value with a reference value to produce an error signal; and means for varying the pressure in dependence on said error signal to reduce any difference between the measured value and the reference value.

The measured value may be the actual pressure applied to the package. As already stated, the pressure-applying means may be a bar or roller and, in this case, the measured value may be the load pressure on the bar or roller. However, since the rolling resistance will vary with the applied pressure, it is preferred that the measured value should be the rolling resistance or a quantity which varies with the rolling resistance. For example, the measured value may be the circumferential force applied to the pressure-applying means by rotation of the package or may be the load on the motor due to the rolling resistance. It is to be understood that the load on the motor will be higher during acceleration than during normal running and, accordingly, means may be provided to inhibit the operation of the pressure-varying means until the motor has reached its normal operating speed.

In yet another alternative arrangement, separate means are provided to measure the deformability of the package and this measurement may be used as the measured value.

This measurement may be obtained by a separate roller arranged to measure the peripheral force on the roller due to deformation of the package.

Since, in most practical cases, the pressure required will always reduce during the winding of a package, the means provided in accordance with the invention for varying the pressure may be designed solely to reduce this pressure from an initial starting value which may be, for example, capable of being set in by an operator.

In some circumstances, the ideal pressure may vary during the winding of a package and, accordingly, means may be provided to measure the diameter of the package and to vary the reference value in dependence on the measured diameter. This variation of pressure may be required in order to produce a constant packing density throughout the package, or may be required in order to vary the packing density at different diameters.

The invention may be utilised to improve the package side wall quality. In particular, it may be used to produce a package with parallel walls. A further beneficial result of controlling the pressure on the package is to provide a better lay and thus to improve the quality of the package build.

As in the case of the known apparatus already mentioned, the pressure-applying means may comprise a bar or roller fixed in the vertical direction, the pressure resulting from the reaction force caused by pressing the package against the bar or roller. For this purpose, the mandrel may be rotatably mounted on an arm which is itself mounted to pivot about a horizontal axis. A weight may be connected to the arm to press the package against the bar or roller, and the pressure-varying means may comprise means for applying a force to the arm in opposition to the weight.

In a system of the kind described in the preceding paragraph, the error signal may be produced not only by comparing the value which varies with the pressure applied to the package with the reference value, but also in dependence on a measurement of the force applied to the arm in opposition to the weight. It has already been stated that the reference value may be varied in dependence on a measurement of the diameter of the package and, in a modification of the invention, the error signal depends solely on the measurements of the diameter of the package and the opposition force applied to the arm.

In a particular embodiment of the invention, the opposition force is applied to the arm by means of a piston slidable in a cylinder to which air is admitted under pressure. In this case, the error signal may control an electric motor driving a pump to supply the air to the cylinder. In addition, the measurement of the opposition force may be derived from a measurement of the air under pressure in the cylinder.

From a second aspect the invention consists in apparatus for winding flexible material on to a mandrel rotatably mounted on an arm itself mounted to pivot about a horizontal axis including: means for rotating the mandrel; gravitationally-responsive means applying a downward force to said arm; a bar or roller on which the package of said material wound on said mandrel rests; means for applying a force to said arm in opposition to said gravitationally-responsive means; means for producing a first signal dependent on the force applied to said arm by said force-applying means; means for producing a second signal dependent on the diameter of the package; and means for varying the force applied by said force-applying means to reduce any difference between the first and second signals.

In the case in which the pressure is applied to the periphery of the package by means of a roller, it has been assumed that the pressure is varied by directly altering the radial force applied to the package by the roller. However, it is also possible to vary this pressure by altering the tangential force applied to the package by the roller. For this purpose, means may be provided to rotate the roller, and the pressure may be varied by altering the torque applied to the roller. If desired, the torque variation may be used in addition to control of the radial force. In particular, the error signal may be used to control an electric motor driving the roller until a predetermined torque has been applied, whereafter, the error signal is used to control the means for applying the opposition force to the arm. However, in some circumstances, it may be possible to depend entirely on the torque variation and dispense with the variation of the force on the arm.

One method of performing the invention will not be described with reference to the accompanying diagrammatic drawings, in which.

Figure 1:
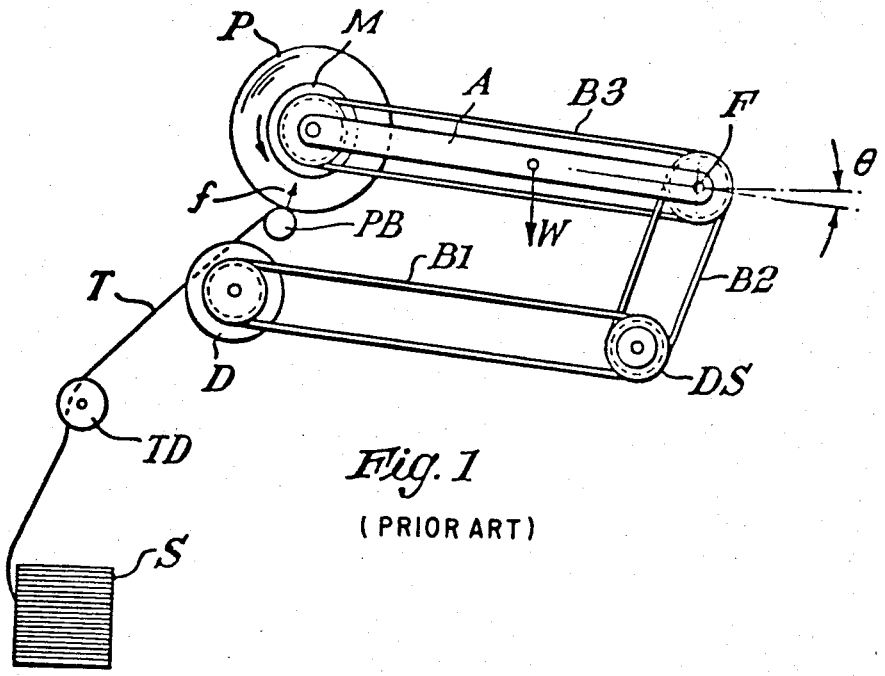
Fig. 1 (PRIOR ART)
FIG. 1 illustrates known apparatus for winding a package of thread from a parent package.

The apparatus illustrated in FIG. 1 includes a mandrel M rotatably mounted at one end of an arm A. This arm is pivotable about a horizontal axis F, and an idler pulley is rotatable about the same axis. An electric motor drives a shaft on which is mounted a pulley DS. A belt B2 couples the pulley DS to the idler pulley, and a belt B3 couples the idler pulley to a further pulley fixed to the mandrel M. Thus the motor drives the mandrel at any angular position of the arm A.

Rotation of the mandrel M pulls the thread T from a parent package S to wind the package P on the mandrel M. A pressure bar PB supports the mandrel M, the package P, and the arm A, and the reaction force f between the pressure bar and the package may be adjusted by means of a weight W.

In the arrangement shown, the thread T is pulled through a tension disk TD to control winding tension and, in addition, passes through a helical groove in a drum D used to oscillate the thread along the mandrel M in order to form the package length. The drum D is rotated by the same motor as the mandrel by means of a belt B1 connecting the pulley DS to a further pulley fixed to the drum.

In use, the force f is adjusted by changing the weight W in order to control the package density, and the weight W has to be varied as the diameter of the package increases in order to give satisfactory results. In practice, this involves manual adjustment of the weight W, and the arrangement is unreliable primarily because of frictional forces which are variable throughout the operating cycle of the machine.

Figure 2:
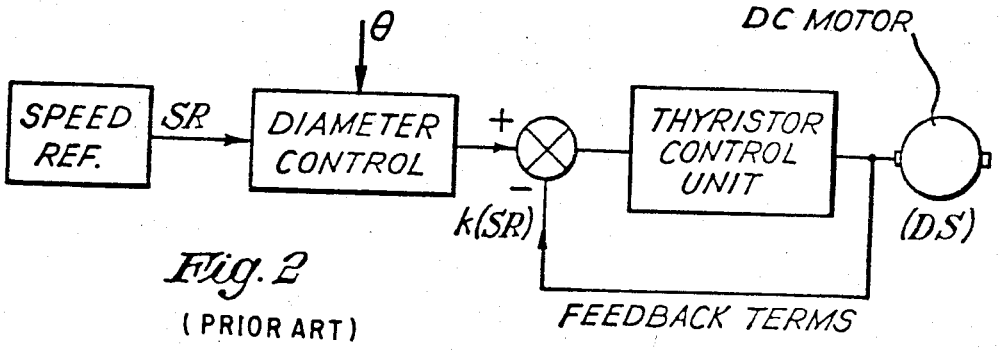
Fig. 2 (PRIOR ART)
FIG. 2 illustrates a known circuit for controlling the winding speed.

FIG. 2 shows a known arrangement of control equipment for maintaining the peripheral speed of the package constant. Means are provided for measure the angle $\theta$ (FIG. 1) which is the angle of the arm A relative to a reference position at the commencement of the package wind. The peripheral speed reference SR is set in by the operator, and is modified by diameter control means in proportion to the inverse of the angle $\theta$. The resulting signal is applied to a thyristor converter which supplies the DC motor which drives the pulley DS. Feedback terms are obtained from the output of the converter or from the motor speed to linearise the motor speed, and to maintain it proportional to the product of the speed reference SR and the inverse of the angle $\theta$. Since the peripheral speed of the package is the product of the motor shaft speed and the diameter, this arrangement maintains the peripheral speed constant as the package diameter increases.

Figure 3:
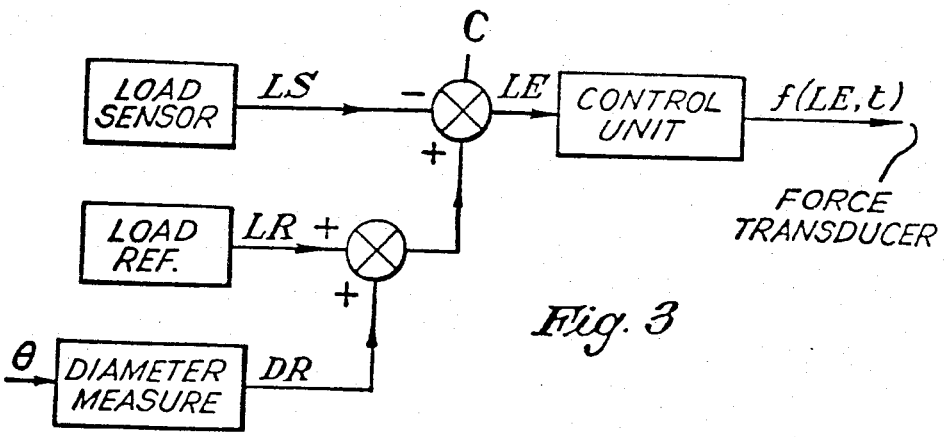
FIG. 3 illustrates the basic principle of apparatus in accordance with the invention.

The basic arrangement of apparatus in accordance with the invention is shown in FIG. 3. Means are provided in an arrangement similar to that of FIG. 1 to provide a signal which is proportional to the rolling resistance of the package f. This arrangement is indicated in FIG. 3 by the load sensor which produces a signal LS. A load reference LR is set in by the operator, and signals LS and LR are compared to produce an error signal LE. This signal LE is provided to a control unit which controls a force transducer which varies the effective weight of the weight W in the direction necessary to reduce the error signal LE towards zero.

The load sensor LS may be arranged to provide a direct measurement of the rolling resistance f, for example, by means of load cells fitted to the pressure bar or roller PB. Alternatively, since the load on the drive motor is proportional to the rolling resistance of the package, the motor load current may be used to provide a measure of rolling resistance.

In the particular arrangement shown in FIG. 3, the load reference signal is modified by means of a signal DR which is dependent upon the angle $\theta$, and hence on the diameter of the package. This modifying signal may be used, for example, to provide variable density as the package diameter changes.

Figure 4:
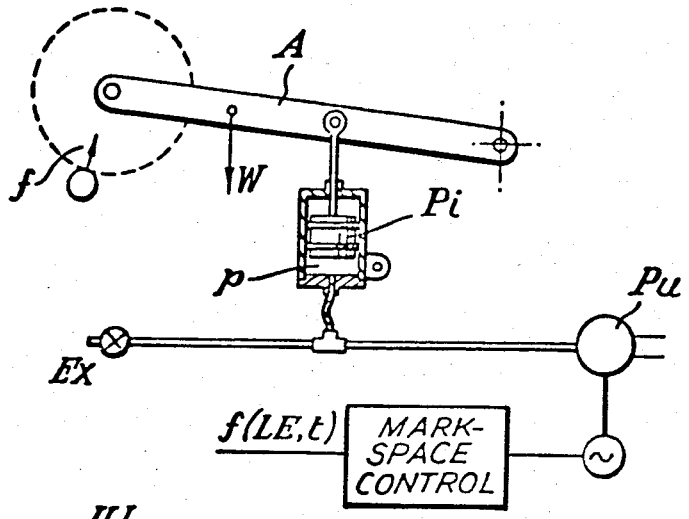
FIG. 4 shows one embodiment of the invention.

FIG. 4 illustrates one particular arrangement for varying the effective value of the weight W. In this particular arrangement, the total weight of the arm and mandrel is arranged to exceed the maximum weight required to achieve a maximum value of the force f, and a transducer is provided to support the arm and thus reduce the effective weight W. The transducer comprises a piston slidable in a cylinder, the axis of which is substantially vertical. The piston rod is pivotally connected to the arm A, and seals are provided between the piston and the cylinder. A pump is provided to supply air to the end of the cylinder remote from the piston rod so that a force can be applied to the piston rod in opposition to the weight of the arm A. The pump is driven by an electric motor through a mark-space control unit which controls the number of revolutions performed by the motor in any particular time period. Preferably the mark-space control unit operates with a constant period, and varies the length of the mark in each period in dependence on the input signal. Thus the input signal controls the time during each period for which the motor is permitted to run, and hence controls the amount of air supplied to the cylinder during each period. The input of the mark-space control unit is constituted by the error signal LE or a signal proportional thereto. In this way, the average rate of flow through the pump may be changed in accordance with the error signal LE. The control unit can include a limit mechanism for inhibiting control unit operation when the motor has reached a normal operating speed.

As shown in FIG. 4, an exhaust and restrictor valve is provided to enable the air to be exhausted from the cylinder. Normally the exhaust valve is closed, but it may be opened to allow the air to exhaust slowly through the restrictor valve in order to lower the arm A. Similarly, means may be provided to supply air to the cylinder from an alternative source in order to lift the arm. Such raising and lowering of the arm is required during normal winding operations.

Any alternative method of exerting force on the arm A may be used, and the pressure within the cylinder may be arranged to be controlled by a closed-loop control system where the reference is taken from the error signal LE. In yet another alternative arrangement, a solenoid valve may be used as a pulsing control in place of the pump.

It will be understood that the pneumatic system provides a variable force to the arm, but does not positively control the angular position of the arm. Accordingly, if it is desired to use a hydraulic system in place of a pneumatic system, it is necessary to provide a spring connection between the hydraulic piston and the arm.

In yet another alternative system, a mechanical ratchet arrangement may be used to raise the arm during winding. Again in such a system it is necessary that there should be a spring connection between the ratchet and the arm so that the ratchet does not positively define the position of the arm, but applies a varying pressure thereto.

Figure 5:
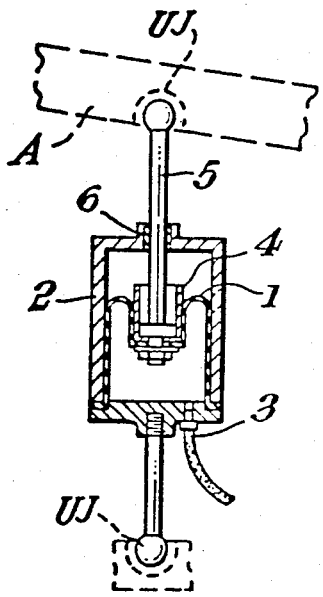
FIG. 5 shows a particular pressure-control means for use in connection with the apparatus illustrated in FIG. 4.

One particularly convenient type of pneumatic transducer is illustrated in FIG. 5. In this arrangement, a flexible, and preferably resilient, diaphragm 1 is fitted in the cylinder 2. The diaphragm is sealed to the cylinder and an air inlet to the lower side of the diaphragm is provided at 3. A piston 4 is supported by the diaphragm 1 and is attached to a connecting rod 5. The connecting rod is slidable in a linear bearing 6 fitted in the upper end of the cylinder 2. The piston rod 5 is pivotally connected to the arm A by means of a universal joint UJ. The cylinder is connected by means of a further universal joint UJ to the frame of the apparatus. The diaphragm 1 is provided with at least one corrugation, and it will be seen that the arrangement can be used for providing an axial force on the piston rod 5 in dependence on the air pressure supplied to the inlet 3. Since the normal seals between the piston and the cylinder are replaced by the diaphragm 1, air leakage in the system is substantially eliminated.

It is to be understood that apparatus in accordance with the invention may be used for winding thread, paper, textile material or synthetic resin material in strip form on to a mandrel or former. In the case of thread, the package formed may be either cylindrical or frustoconical.

The mandrel may be driven by a DC or AC electric motor at a constant or variable mandrel or thread speed. The packing density of the material in the package may be controlled by measurement of the load imposed on the drive motor by the pressure bar or roller which bears on the surface of the package and causes the load signal to act in a closed-loop control system so as to modify the force acting on the pressure bar. In this way, the motor load may be maintained at the load required to maintain packing density.

The rolling resistance may be measured by load cells measuring directly the horizontal force exerted on the roller bar by the rotating package.

As has already been stated, a closed-loop system may be used to control the pressure within the cylinder. For this purpose, a further comparator may be included between the comparator C and the control unit (FIG. 3), and a signal measuring the pressure in the cylinder may be applied to this comparator together with the error signal LE. The output from this comparator will then be applied to the control unit, and the system will operate to reduce towards zero any difference between the value of the pressure in the cylinder and the error signal LE. The relative weights of the signals DR, LR and LS may be adjusted if desired to increase the influence of the diameter measurement on the signal applied to the force transducer and, in the limit, the load sensor and the load reference may be eliminated entirely. Thus, under these conditions, the signal f(LE,t) will depend solely on the difference between the signal DR and the signal measuring the pressure in the cylinder.

Figure 6:
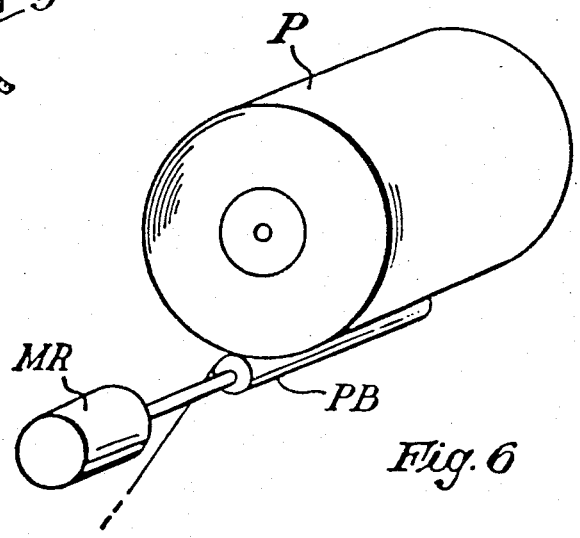
FIG. 6 shows a modification of part of the apparatus illustrated in FIG. 4.

It has already been stated that the winding density of the package may be controlled by altering the tangential force applied to the package by the roller. An arrangement of this kind is illustrated in FIG. 6 in which an electric motor MR is provided to drive the roller PB. If desired, this motor may be driven directly by, or in dependence on, the signal f(LE,t). However, since the tangential force applicable to the package by the roller will normally be relatively limited since it is desirable that the roller PB should have a small diameter, it is preferred that means should be provided for controlling the radial force as well as the tangential force. Under these circumstances, the signal f(LE,t) is used to control the electric motor MR until a predetermined torque has been applied whereafter the signal f(LE,t) is used to control the means for applying force to the arm A.

I claim:

1. An apparatus for winding flexible material to form a package, comprising:

an arm pivotally mounted at one end for movement about a horizontal axis;

a motor-driven mandrel rotatably mounted at an opposite end of said arm;

bar means, adjacent said mandrel, for engaging and supporting a package of material wound on said mandrel;

gravitationally-responsive means, associated with said arm, for urging the package against said bar means such that pressure is applied to the periphery of the package by said bar means;

force transducer means, coupled to said arm, for applying a force to said arm in opposition to said gravitationally-responsive means;

a first sensor means for emitting a first signal representation of actual package rolling resistance;

an input means for emitting a second signal representative of a reference valve for packaging rolling resistance;

control means, coupled to said force transducer means, said first sensor means and said input means, for automatically controlling said force applied by said force transducer means to automatically control packing density of the package in response to differences between said first and second signals by varying said force until said first and second signals are substantially equal.

2. An apparatus according to claim 1 wherein said first sensor means measures package rolling resistance by measuring circumferential forces exerted on said bar means by the package when the package is rotating.

3. An apparatus according to claim 1 wherein said mandrel is coupled to a motor for rotating said mandrel, said first sensor means being coupled to said motor to measure package rolling resistance as a function of motor load.

4. An apparatus according to claim 3 wherein said motor is coupled to said control means for regulating motor operation, said control means including limit means for inhibiting control means operation when said motor has reached a normal operating speed.

5. An apparatus according to claim 1 wherein said input means comprises means for measuring package diameter and for varying the reference value in response to the package diameter.

6. An apparatus according to claim 1 wherein said force transducer means is pneumatic.

7. An apparatus according to claim 6 wherein said force transducer means comprises a cylinder and a piston slidable in said cylinder, said cylinder having a vertical axis and inlet means for admitting pressurized air in said cylinder to oppose said gravitationally responsive means.

8. An apparatus according to claim 7 wherein said inlet means is coupled to a pump driven by an electric motor, said motor being coupled to and regulated by said control means in response to differences in said first and second signals.

9. An apparatus according to claim 8 wherein said cylinder comprises a flexible diaphragm dividing said cylinder into first and second air-tight compartments, said piston being located in said first compartment, said inlet means admitting pressurized air into said second compartment.

10. An apparatus according to claim 9 wherein second sensor means produces a feedback signal representative of pressure in said cylinder, said control means comparing said feedback signal with the differences between said first and second signals to produce a control signal for said electric motor.

11. An apparatus according to claim 8 wherein second sensor means produces a feedback signal representative of pressure in said cylinder, said control means comparing said feedback signal with the differences between said first and second signals to produce a control signal for said electric motor.

* * * * *